US006505549B2

(12) United States Patent
Brox

(10) Patent No.: US 6,505,549 B2
(45) Date of Patent: Jan. 14, 2003

(54) METHOD OF AND AN APPARATUS FOR PROTECTING THE JACKET UPON A WEB BREAK IN A HOT SHOE PRESS ROLL NIP

(75) Inventor: Erik Brox, Forshaga (SE)

(73) Assignee: Metso Paper Karlstad AB, Karlstad (SE)

( * ) Notice: Subject to any disclaimer, the term of this patent is extended or adjusted under 35 U.S.C. 154(b) by 128 days.

(21) Appl. No.: 09/796,248

(22) Filed: Feb. 28, 2001

(65) Prior Publication Data

US 2002/0059872 A1 May 23, 2002

Related U.S. Application Data

(60) Provisional application No. 60/264,154, filed on Jan. 25, 2001.

(30) Foreign Application Priority Data

Nov. 20, 2000 (SE) ..... 0004258

(51) Int. Cl.[7] ..... B30B 15/34

(52) U.S. Cl. ..... 100/38; 100/47; 100/153; 100/170; 162/358.3

(58) Field of Search ..... 100/38, 47, 153, 100/170, 341; 492/7, 20; 162/205, 206, 358.3, 358.5, 359.1

(56) References Cited

U.S. PATENT DOCUMENTS 4,563,245 A 1/1986 Wanke et al.
6,158,333 A 12/2000 Honkalampi et al.
6,158,335 A 12/2000 Safman et al.

FOREIGN PATENT DOCUMENTS

DE 32 27 768 A1 1/1984
DE 299 02 451 U1 7/1999
DE 199 30 983 A1 2/2000

OTHER PUBLICATIONS

International–Type Search Report, Search Request No. SE 00/01832 completed Jun. 28, 2001.

*Primary Examiner*—W. Donald Bray
(74) *Attorney, Agent, or Firm*—Alston & Bird LLP

(57) ABSTRACT

In a roll nip (5) formed between a shoe press roll (1) having a concave, plane or slightly convex press shoe (11), a flexible jacket (15) and a hot counter roll (3), the jacket (15) may be damaged by the heat from the counter roll (3) upon a web break. To avoid this, the roll nip (5) is opened by removing one of the press shoe (11) and the hot counter roll (3) from the other, so that the jacket (15) resumes a generally cylindrical shape having an arched portion located across the shoe (11). Then, a force is applied inside the roll jacket (15), directed away from the roll nip (5), to tension the roll jacket (15) over the leading edge and the trailing edge of the press shoe (11), so as to reduce the height of arch of the arched portion over the shoe (11) sufficiently to ensure removal of the jacket (15) from contact with the hot counter roll (3). Preferably, the force against the inside of the jacket is applied by means of a tensioning shoe (61). Suitably, the tensioning shoe is operated by a linear actuator (59), e.g. a fluid force actuator, carried by a support beam (17) that extends axially through the flexible jacket (15).

9 Claims, 4 Drawing Sheets

METHOD OF AND AN APPARATUS FOR PROTECTING THE JACKET UPON A WEB BREAK IN A HOT SHOE PRESS ROLL NIP

CROSS-REFERENCE TO RELATED APPLICATION

The present application claims the benefit of the filing date of U.S. Provisional Patent Application No. 60/264,154, filed Jan. 25, 2001.

FIELD OF THE INVENTION

The present invention relates to a method and apparatus of preventing a flexible jacket, which is included in a roll nip formed between a shoe press roll having a concave, plane, or slightly convex press shoe, and the flexible jacket and a hot counter roll, from getting damaged by the heat from the counter roll upon a web break. The method includes the step of opening the roll nip by removing one of the press shoe and the hot counter roll from the other, whereby the jacket resumes a generally cylindrical shape having an arched portion located across the shoe.

BACKGROUND OF THE INVENTION

When running a shoe press, the shoe usually is concave and the flexible jacket will be pressed down to the bottom of the shoe when the jacket passes through the roll nip. In a press having a warm or hot counter roll it is important that the jacket does not come into direct contact with the warm/hot roll surface, because the jacket material will not stand the temperature that it will be exposed to if the wet paper web to be pressed will not keep the jacket insulated from the roll surface. Therefore, it has been suggested, see German Utility Model DE-U1 299 02 451 (Valmet) or U.S. Pat. No. 6,158,335, for example, to find out by means of a sensor when a web break occurs in a hot calendering process and to emit a signal from the sensor to a controller, which controls the hot calendering process. Upon a web break, the controller sees to it that the counter roll is lifted away from contact with the shoe press roll, and/or that the press shoe in the shoe press roll is withdrawn sufficiently for the flexible shoe press jacket not to contact the hot counter roll. To make sure that the jacket will not be damaged by heat, it may be necessary to open the press a comparatively long distance if the roll nip is long and the counter roll is of a small diameter. This will require that press actuators as well as a frame mechanism have long strokes. However, it is desirable to use existing press actuators and frame structures.

Earlier it has been proposed, see U.S. Pat. No. 4,563,245 (Voith), for example, to stabilize a rotating flexible roll jacket in a shoe press roll by tensioning it in circumferential direction, so that it is forced inward against a tubular, substantially cylindrical support body, which is supported by and surrounds a support beam for the roll. The cylindrical support body directly supports the press shoe, and the shoe is operated by means of a row of hydraulic actuators, which supported by the support beam act against the inside of the cylindrical support body. The tensioning of the roll jacket is achieved by a tensioning shoe placed diametrically opposed to the press shoe and operated by means of its own hydraulic actuators. Upon forcing the tensioning shoe radially outward against an adjacent portion of the jacket, the other portion of the jacket will be tensioned inward against the cylindrical support body.

German patent DE-A1 32 27 768 (Voith) illustrates that a suction chamber may be used as an alternative to the tensioning shoe. A portion of the jacket is sucked into the suction chamber, so that the jacket will be tensioned against the cylindrical support body.

There also is a suggestion, see German patent DE-A1 199 30 983 (Valmet), for example, to provide expandable support elements inside the shoe press roll. When handling the roll, for example, these support elements are activated to permit lifting of the roll by means of strip-shaped lifting straps, which press against the flexible roll jacket, without the pressure from the weight of the roll causing the lifting straps to do damage to the jacket.

SUMMARY OF THE INVENTION

The object of the present invention is to provide a method and an apparatus of the kind initially referred to, which permit the use of existing press actuators and frame structures, at the same time as the opening of the press when necessary still will be ensured, in order to avoid heat damage to the jacket.

In accordance with the invention this object is achieved, in the method initially referred to, by applying a force inside the roll jacket, directed away from the roll nip to tension the roll jacket over the leading edge and the trailing edge of the press shoe, so as to reduce the height of arch of the arched portion over the shoe sufficiently to ensure removal of the jacket from contact with the hot counter roll.

Similarly, this object is achieved, in the apparatus initially referred to, in that second means are provided for applying a force inside the roll jacket, directed away from the roll nip, to tension the roll jacket over the leading edge and the trailing edge of the press shoe, so as to reduce the height of arch of the arched portion over the shoe sufficiently to ensure removal of the jacket from contact with the hot counter roll.

Preferably, the force is applied by means of a tensioning shoe that said second means, which suitably includes a fluid force linear actuator, forces against the inside of the roll jacket. It is also suitable to have said second means carried by a support beam that extends axially through the flexible roll jacket. Thereby, a simple but yet reliable design is achieved.

For cost saving reasons it is suitable that the tensioning shoe consists of bent sheet metal, and it suitably has upturned leading edge and trailing edge.

Preferably, the tensioning shoe has a convex side that upon activation of its associated linear actuator is intended to contact the inside of the flexible jacket. Then, it is suitable that the curvature of the convex side is such that—when the linear actuator has forced the tensioning shoe outward against the jacket to such an extent that removal of the jacket from the hot counter roll is ensured—the local pressure between the tensioning shoe and the jacket is of the same order of magnitude over the entire convex side of the tensioning shoe.

The term "shoe press roll" is used here to designate a shoe roll having a flexible jacket, irrespective of whether it is used in a press, calender or surface sizing or coating equipment.

In the present context, the expression "slightly convex" shall be understood to mean that the radius of curvature of the shoe is larger than that of the flexible jacket, when in an operative shoe press roll the jacket is ready to be pressed against the counter roll by means of the shoe to form the roll nip. Thanks to the differences in radius of curvature, the jacket will get an arched portion straight across the shoe, and the jacket may contact the leading edge and the trailing edge of the shoe. Between these two edges the jacket will have an arch height in relation to the shoe, so that the jacket will contact the counter roll also when the shoe is removed a maximum distance from the counter roll.

The invention will be described more in detail below with reference to the appended drawings.

DETAILED DESCRIPTION OF THE PREFERRED EMBODIMENTS

Figure 1:
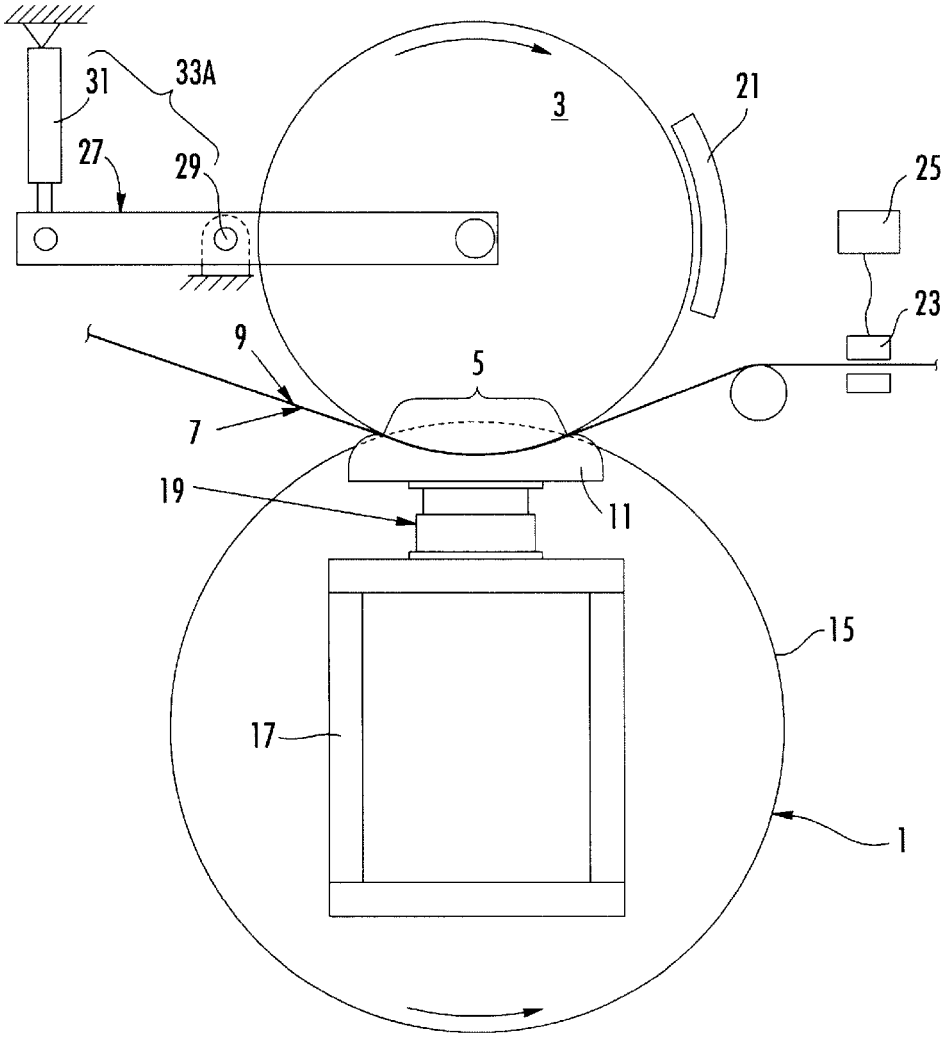
FIG. 1. (PRIOR ART)
FIG. 1 is a simplified cross-sectional view of a press in accordance with prior art and having a shoe press roll and a heatable, pivotally mounted counter roll in closed position for normal operation.
Figure 2:
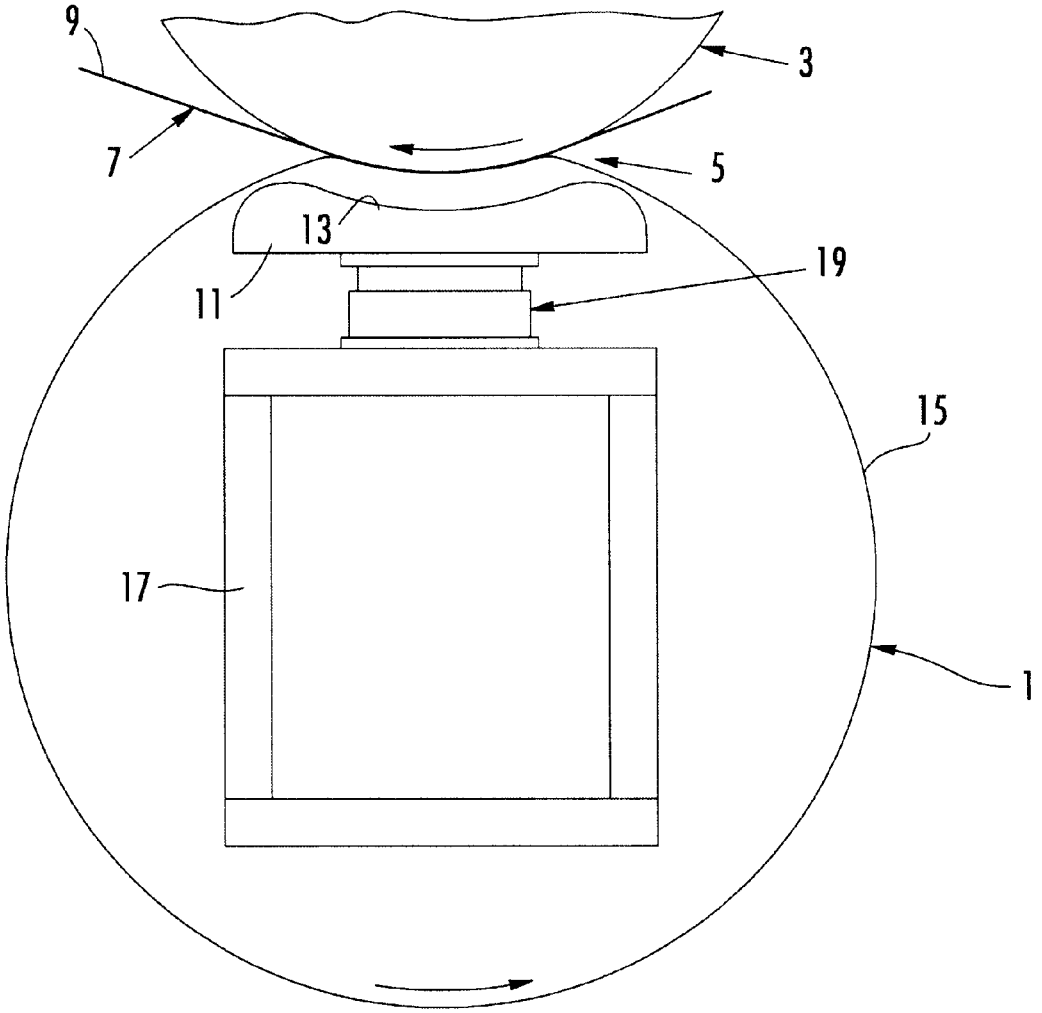
FIG. 2. (PRIOR ART)
FIG. 2 is a simplified cross-sectional view of the press in accordance with FIG. 1 in open condition, so that the press shoe in the shoe press roll is removed maximally from the counter roll, but with the flexible jacket still in contact with the hot counter roll.

FIGS. 1 and 2 show a prior art press. The press includes a shoe press roll 1 and a counter roll 3, which together define a roll nip 5 extended in the machine direction. In the shown embodiment, an endless felt loop 7 runs through the roll nip 5, and felt 7 carries a fibrous web 9, such as a paper web or a board web, which is to be pressed. Further, in the shown embodiment the shoe press roll 1 is placed under the counter roll 3 and the fibrous web 9 is located between the felt 7 and the counter roll 3. The shoe press roll 1 includes a press shoe 11 having a concave, plane or slightly convex press surface for cooperation with the counter roll 3, a surrounding flexible roll jacket 15, which usually consists of reinforced polyurethane, and a stationary support beam 17 that carries the press shoe 11 and extends axially through the flexible roll jacket 15. The axial ends of the roll jacket 15 are fixed to heads, not shown, which are rotatably journaled on the support beam 17. To move the press shoe 11 against and away from the counter roll 3 located outside of the flexible jacket 15, the support beam 17 carries at least one linear actuator 19, suitably at least one row of fluid force actuators, preferably hydraulic cylinders. Further, in some cases it is suitable that the flexible jacket 15 may be driven by a drive, not shown, in a manner known per se, see e.g. U.S. Pat. No. 6,158,335, which is expressly incorporated herein by reference.

In the shown embodiment, the counter roll 3, which at least in wide machines suitably is a deflection controlled roll, e.g. one of the rolls in Valmet Corporation's roll family named SYM-Z™ rolls, is arranged to be externally heated in a manner known per se by a heater 21, e.g. an induction heater. Further, a sensor 23 is positioned upstream of the roll nip 5 and is arranged to sense a possible web break, i.e. absence of the fibrous web 9 on the felt 7. Upon a web break, a control unit 25 connected to the sensor 23 is informed thereof and immediately retracts the press shoe 11 maximally toward the support beam 17, as will be described more in detail in connection with FIG. 3 below. Simultaneously, the control unit 25 sees to it that the hot counter roll 3 and the shoe roll 1 will be removed from each other. In the shown embodiment, this removal is achieved in that the counter roll 3 is pivotally mounted on a pair of two-armed levers 27, which can be turned on a fixed fulcrum. Two actuators 31 controlled by the control unit 25, e.g. hydraulic cylinders, are mounted between an associated one of the free, opposite lever ends and the machine frame for turning the levers 27 on the fulcrums 29, so as to space apart the shoe press roll 1 and the counter roll 3 from each other. Together, the levers 27, the fulcrums 29 and the actuators 31 constitute a first embodiment 33A of a first means for removing one of the press shoe 11 and the hot counter roll 3 from the other upon a web break.

As mentioned above, the press shoe 11 is moved in a direction towards and away from the counter roll 3, which is located outside the flexible jacket 15, by at least one linear actuator 19, suitably at least one row of fluid force actuators, preferably hydraulic cylinders, which are carried by the support beam 17. In the preferred embodiment described below, double-acting hydraulic cylinders 19 are used, one of which is shown in FIG. 1. However, as a person skilled in the art easily realizes, it is within the framework of the present invention the use single-acting pushing cylinders for pressing the shoe 11 against the counter roll 3 and then use single-acting pulling cylinders for retracting the shoe 11 toward the support beam 17. Instead of hydraulic cylinders, also other actuators may be used, e.g. ball screws or roller screws. These have rotary recirculating balls or grooved rolls or rotary non-recirculating threaded rolls provided between a nut and a screw extending through the nut and rotatable in relation to the nut. To retract the press shoe 11 towards the support beam 17 it is, of course, possible to use other well known appropriate return members, e.g. helical springs.

Figure 3:
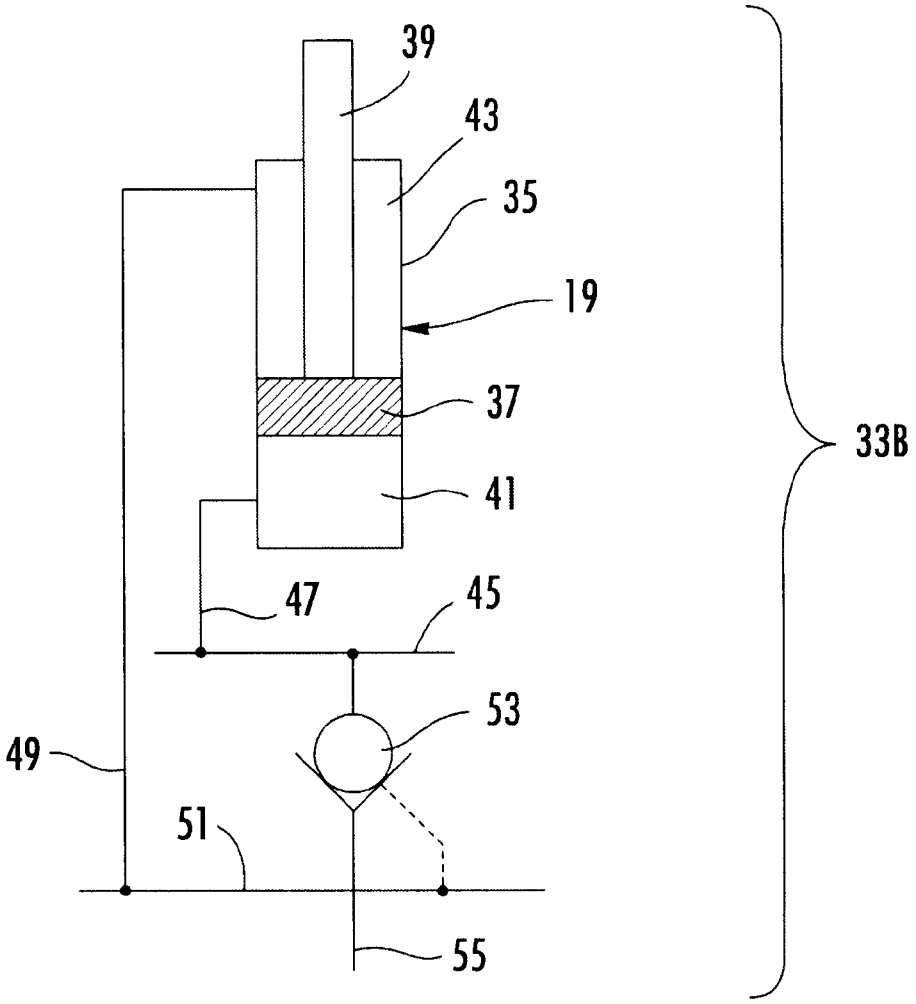
FIG. 3. (PRIOR ART)
FIG. 3 is a simplified schematic diagram of a part of a hydraulic circuit having a hydraulic actuator, e.g. for operating the press shoe.

FIG. 3 schematically shows a double-acting hydraulic cylinder 19 with associated hydraulic medium conduits for operating the press shoe 11. The shown hydraulic cylinder is of conventional design with a cylinder 35 and a piston 37 displaceable in the cylinder. The piston 37 has a projecting piston rod 39 that is connected to the press shoe 11, not shown. In the cylinder 35, the piston 37 separates a push chamber 41 and a pull chamber 43 from each other. A first main conduit 45 is arranged to supply hydraulic medium through a first branch conduit 47 to the push chamber 41. Then the piston 37 via the piston rod 39 presses the shoe 11 toward the counter roll 3 and hydraulic medium is removed from the pull chamber 43 via a second branch conduit 49 to a second main conduit 51. The first main conduit 45 is via a controllable check valve 53 connected to a discharge conduit 55. The check valve is adapted to open when the pressure in the second main conduit 51 is higher than in the first main conduit 45, and this condition arises on reversal of the pressure in the conduits to accomplish a retraction of the piston 37 and the press shoe 11. By using a controllable check valve it is possible to provide a faster retraction of the press shoe 11 from the roll nip 5. Together the row of double-acting hydraulic cylinders 19 with its associated conduit system 45–51 and 55 and the controllable check valves 53 constitute a second embodiment 33B of the first means for removing one of the press shoe 11 and the hot counter roll 3 from the other upon a web break.

As touched upon above, when the sensor 23 discovers a web break, the control unit 25 is informed thereabout and sees to it that the roll nip 5 opens in a suitable way, so that the press shoe 11 will be removed from the counter roll 3. It is preferred to use both the lifting of the counter roll 3 and the retraction of the press shoe 11 and to carry out both of the steps simultaneously. If the press shoe 11 is wide in the machine direction, the situation shown in FIG. 2 may arise. The roll nip 5 is opened maximally and the press shoe is retracted maximally, whereby the jacket 15 resumes a substantially cylindrical shape having an arched portion located across the shoe 11 but, nevertheless, the flexible jacket 15 still contacts the hot counter roll 3. To solve this problem and avoid that the flexible jacket 15 will be damaged by the heat, without having to rebuild the shoe press so that the rolls 1 and 3 can be moved away from each other a longer distance and/or so that the hydraulic cylinders 19 for operating the press shoe 11 get a larger stroke, it is suitable to use the solution shown in FIG. 4.

According to the invention, in connection with the opening of the press nip 5, a force directed away from the roll nip 5 shall be applied inside the roll jacket 15 to tension the roll jacket 15 over the leading edge and the trailing edge of the press shoe 11, so as to reduce the height of arch of the arched portion over the shoe 11 sufficiently to ensure removal of the jacket 15 from contact with the hot counter roll 3.

Figure 4:
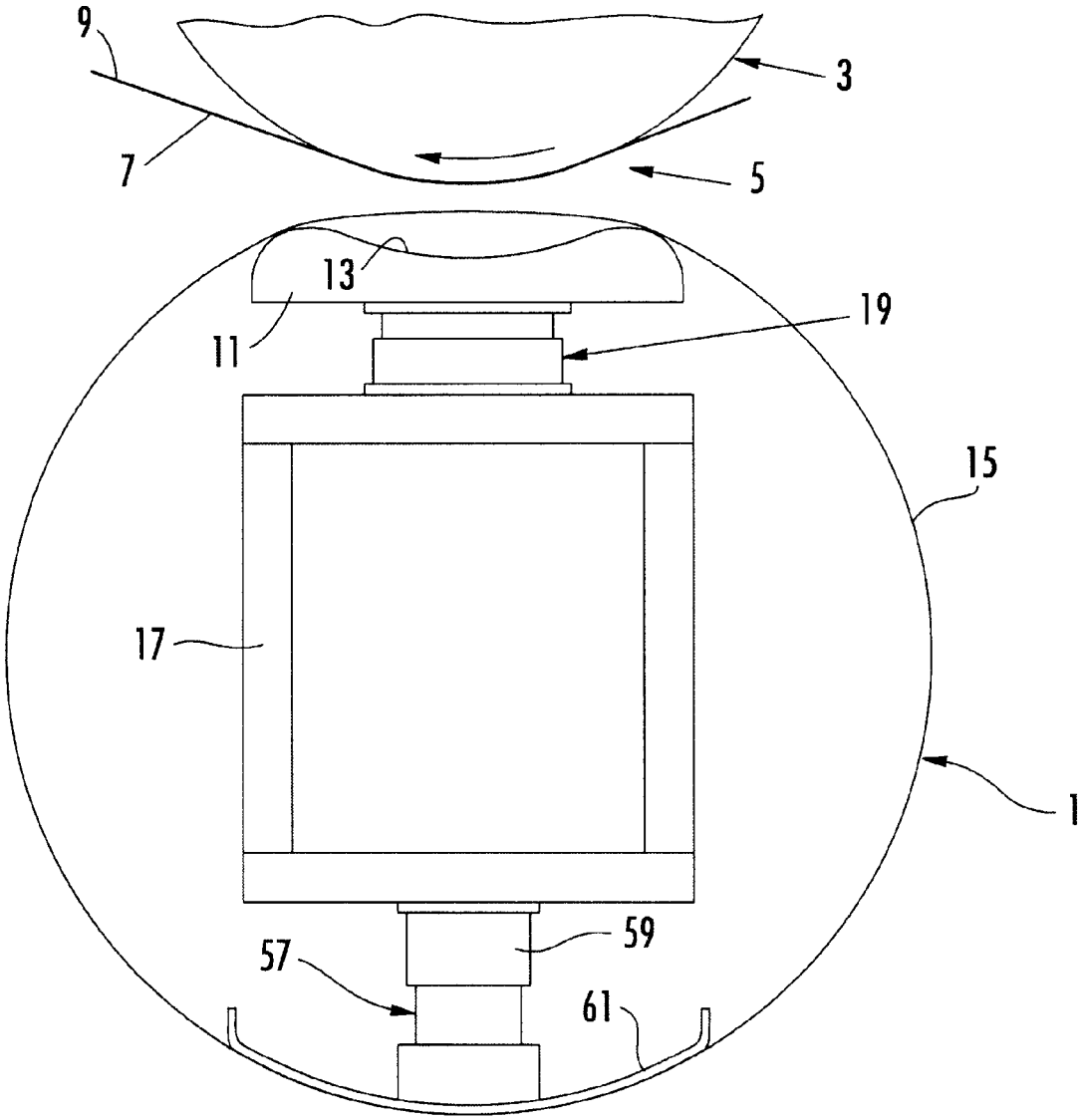
FIG. 4 is a simplified cross-sectional view of a press provided with an apparatus in accordance with the present invention to avoid that upon a web break the flexible jacket will be damaged by the heat from the counter roll.

As shown in FIG. 4, second means 57 are provided for applying a force inside the roll jacket 15, directed away from the roll nip 5, to tension the roll jacket 15 over the leading edge and the trailing edge of the press shoe 11, so as to reduce the height of arch of the arched portion over the shoe 11 sufficiently to ensure removal of the jacket 15 from contact with the hot counter roll 3. The second means 57 suitably includes a tensioning shoe 61 and a linear actuator 59, which is carried by the support beam 17, for pressing the tensioning shoe 61 against the inside of the jacket 15. The linear actuator 59 suitably is placed diametrically opposite to the linear actuator 19 and preferably includes a row of fluid force actuators, such as hydraulic cylinders. The hydraulic cylinders 59 may be double-acting, or single-acting if supplemented with appropriate retractors for the tensioning shoe 61. During normal operation the tensioning shoe 61 is retracted from contact with the inside of the flexible jacket 15.

Since the tensioning shoe 61 will not be exposed to any appreciable forces, it can be of simple design and, as shown in FIG. 4, may be a bent piece of sheet metal, suitably having an upturned leading edge and trailing edge. It has a convex side, which on activation of the linear actuator 59 is adapted to contact the inside of the flexible jacket 15. The curvature of the convex side suitably is such that—when the linear actuator 59 has forced the tensioning shoe 61 outward against the jacket 15 to such an extent that removal of the jacket 15 from the hot counter roll 3 is ensured—the local pressure between the tensioning shoe 61 and the jacket 15 is of the same order of magnitude over the entire convex side of the tensioning shoe.

What is claimed is:

1. A method of preventing a flexible jacket from getting damaged in a shoe press roll nip formed between a press shoe defining a press surface and a heated counter roll, said method including the steps of:

opening the roll nip upon a break occurring in a web being passed through the roll nip by removing at least one of the press shoe and the heated counter roll from the other, such that the jacket assumes a generally cylindrical shape having an arched portion spaced from the press surface of the press shoe; and applying a force inside the roll jacket to tension the roll jacket over the press surface of the press shoe so as to reduce the height of the arched portion over the shoe sufficiently to ensure removal of the jacket from contact with the heated counter roll.

2. A method as claimed in claim 1 wherein said force applying step comprises applying the force by a tensioning shoe.

3. An apparatus for preventing a flexible jacket from getting damaged in a shoe press roll nip formed between a press shoe defining a press surface and a heated counter roll, said apparatus comprising:

means for removing at least one of the press shoe and the heated counter roll from the other upon a break occurring in a web being passed through the roll nip, such that the jacket assumes a generally cylindrical shape having an arched portion spaced from the press surface of the press shoe; and means for applying a force inside the roll jacket to tension the roll jacket over the press surface of the press shoe so as to reduce the height of the arched portion over the shoe sufficiently to ensure removal of the jacket from contact with the heated counter roll.

4. An apparatus as claimed in claim 3 wherein the shoe press roll further comprises a support beam and wherein;

said removing means further comprise a linear actuator carried on the support beam within the flexible jacket for operating the press shoe; and said force applying means includes a tensioning shoe and a linear actuator that are carried by the support beam for pressing the tensioning shoe against the inside of the jacket.

5. An apparatus as claimed in claim 4 wherein the tensioning shoe and its associated linear actuator are located diametrically opposed to the press shoe and its linear actuator.

6. An apparatus as claimed in claim 4 wherein the linear actuator associated with the tensioning shoe includes a fluid force actuator.

7. An apparatus as claimed in claim 4 wherein the tensioning shoe comprises a sheet metal tensioning surface having upturned leading and trailing edges.

8. An apparatus as claimed in claim 4 wherein the tensioning shoe has a convex side which, upon activation of its associated linear actuator, is adapted for contacting an inside surface of the flexible jacket.

9. An apparatus as claimed in claim 8 wherein the convex side of the tensioning shoe defines a curvature in the direction of the rotation of the jacket such that the local pressure between the tensioning shoe and the jacket is of the same order of magnitude over the entire convex side of the tensioning shoe when the tensioning shoe is activated.

* * * * *